US006349491B1

(12) United States Patent
Able

(10) Patent No.: US 6,349,491 B1
(45) Date of Patent: Feb. 26, 2002

(54) FOLDABLE POSTER SIZED CARD DISPLAY APPARATUS HAVING POCKETS AND HEADER

(76) Inventor: Roy Eugene Able, 11438 Deer Ridge La., Minnetonka, MN (US) 55343

( * ) Notice: Subject to any disclaimer, the term of this patent is extended or adjusted under 35 U.S.C. 154(b) by 0 days.

(21) Appl. No.: 09/571,205

(22) Filed: May 16, 2000

(51) Int. Cl.[7] ..... G09F 1/00

(52) U.S. Cl. ..... 40/124.01; 40/124.06; 40/124.2

(58) Field of Search ..... 40/124.02, 124.01, 40/606, 610, 124, 124.2, 124.15, 642.02, 657, 605, 737, 757, 537, 661, 706; 150/147, 145, 146; D20/40, 10; 211/45, 55, 41.1, 195, 128.1, 41.13; 206/455; 402/79

(56) References Cited

U.S. PATENT DOCUMENTS 5,087,145 A * 2/1992 Cooley
5,184,658 A * 2/1993 Bauman
5,375,352 A * 12/1994 Morris
5,544,436 A * 8/1996 Lafkowitz ..... 40/124.2

* cited by examiner

*Primary Examiner*—Douglas C. Butler

(57) ABSTRACT

A poster sized card display apparatus. The apparatus has a plurality of pockets for displaying a plurality of cards. The apparatus is transparent such that both the front and back sides of the cards are viewable. The apparatus is flexible and can be folded for shipping along portions between rows of cards without disturbing the rows of cards. The apparatus includes vertically oriented pockets for vertically oriented cards and horizontally oriented pockets for horizontally oriented cards. The apparatus includes a header that is at least semi-rigid for providing support to the cards when the apparatus is in a folded form and for providing a degree of rigidity to the flexible apparatus when the apparatus is folded out for display. The apparatus includes pocket seals that terminate short of fold lines so that the apparatus can be easily folded. The apparatus includes double seals about portions of the periphery to protect the outer edges of outermost cards.

18 Claims, 6 Drawing Sheets

24
10
22
11
40
32
38
36
14
16
58
12
19
42
46
18
29
30
62
3B
3A
44
60
54
17
52
50
20
56
34
48

26
114
118
116
104
112
98
96
93
90
94
88
74
76
78
80
122
92
124
88
90
82
84
106
86
115
108
116
126
102
98
100
114
110
120

FOLDABLE POSTER SIZED CARD DISPLAY APPARATUS HAVING POCKETS AND HEADER

BACKGROUND OF THE INVENTION

The present invention relates generally to card display apparatus, particularly to poster sized card display apparatus, and specifically to poster sized card display apparatus having a header that is at least semi-rigid, having vertical and horizontal pockets for the cards, and having spaces between the rows of pockets such that the poster sized card display may be folded for storage and shipping.

Three conventional card holders are a box, a stand alone plastic pocket and a three ring binder having a set of three holed paper sized plastic sheets, each of which has a set of plastic pockets. Each of these conventional card holders have problems relating to 1) maintaining the condition or quality of the card, 2) inspection prior to buying, 3) theft, 4) display, 5) access, and 6) storage or transport.

A card is usually a paper card. A paper card is fragile and this presents a problem where cards are more than merely a passing hobby for adults, teenagers and children. Cards are business. Adults may collect, trade and sell sport cards. Teenagers may collect, trade and sell Magic® cards. Children may collect, trade and sell Pokemon® cards. Whatever the age, whatever the card, many cards are considered by their owners to have monetary value just like grandfather's old valuable baseball card. To protect his or her investment, the collector, trader or seller shuns the box and encases his or her fragile paper or cardboard card in plastic such as the stand alone plastic pocket or three holed paper sized plastic sheet.

Inspection of the goods is important to the buyer who checks both the front and back sides of the card. Inspection of the goods without directly handling the absorbent paper card is important to the seller. Each of the stand alone plastic pocket and three holed paper sized plastic sheet resolves this problem of avoiding direct handling.

Indirect handling is an unresolved problem of inspection. Plastic pockets—whether of the stand alone type or as part of a three holed paper sized plastic sheet—may not protect the paper edges of the paper cards. In a stand alone plastic pocket, all four edges of the card are prone to being bent or nicked or weakened because it is at these locations that the stand alone plastic is handled. In a three ring binder, only the middle card is fully protected because all of the other eight cards have at least one edge that is adjacent to the periphery of the three holed paper sized plastic sheet. Seven of such cards—the cards along the upper, lower and outer edges of the three holed paper sized plastic sheets—have edges prone to fingers that are turning the three holed paper sized plastic sheets. Three of such cards—the cards along the inner edge of the three holed paper sized plastic sheet—are adjacent to and prone to being bent by the three metal rings. Four of such cards—the cards at the comers of the three holed paper sized plastic sheet—have two edges adjacent to the periphery of the three holed paper sized plastic sheet.

Watch boys trade cards. The seller watches the buyer like a hawk. First, the seller does not permit the buyer to remove the card from its plastic pocket. Second, the seller does not permit the buyer to take the plastic pocket and card out of the seller's sight or presence. The stand alone plastic pocket and card is a small flat object that may be easily pocketed itself.

The problem of theft may be partially resolved by displaying a card or set of cards in the three holed paper sized plastic sheet that is in turn placed in a three ring binder. The large three ring binder is an object larger than the stand alone flat plastic pocket and is therefore less prone to theft. However, the individual three holed paper sized plastic sheets are easily removable from the three ring binder itself. And, since the three ring binder is typically on the counter in front of the buyer, a card may be easily removed from its pocket.

The problem of displaying a card for aesthetic reasons or for sale is compounded by the multiplicity of cards in a set. For example, Pokemon® creators have designed 151 pocket monsters, each of which may have its own card or cards. A major league baseball team has a roster of 26 players. A professional football team starts 11 on defense, 11 on offense, and has a roster of 44 players. A box displays only the front side of the first card of the set. A stand alone plastic pocket displays only one card or, if desired, the front sides of two cards where the cards are placed back to back. A three holed paper sized plastic sheet displays only nine cards or, again if desired, 18 cards where the front sides of the cards in each pocket are placed back to back.

The problem of access has several competing features. The pocket is preferably sufficiently small in size (or preferably holds a single card with sufficient tension) such that the card will remain in the pocket even if the pocket is turned upside down. The pocket is preferably sufficiently large in size (or preferably holds two or more cards with sufficient slack) such that one or more cards are easily inserted into and taken out of the pocket. Of course, a box is easily turned upside down and dumped. Stand alone plastic pockets typically have little tension to sufficiently hold a single card. Some stand alone plastic pockets have a greater rigidity to hold a card more tightly, but at the same time cards are more difficult to insert into and remove from the rigid stand alone plastic pockets. The three holed paper sized plastic sheets provide a fit that has more tension than a stand alone plastic pocket, yet such tension may be too great because of how the pockets are formed on the three holed paper sized plastic sheet.

The problem of storage is cured easily by the box. The box takes up a minimum of space. A three ring binder may sit on a bookshelf However, cards in a box may not be displayed and stored at the same time. Further, the box itself cannot be changed without bending the box. Likewise, a three ring binder cannot take up a minimum amount of space and display its cards at the same time. A three ring binder has only an open spread out form (i.e., a display form) and a closed form (i.e. a stored form).

SUMMARY OF THE INVENTION

A feature of the present invention is the provision, in a poster sized card display apparatus for displaying a plurality of cards where the front and back sides of the cards can be viewed from the front and back sides of the poster/sized card display apparatus and where each of the cards is received in one of the plurality of pockets and where the poster sized card display apparatus is transparent and flat, of an elongate space between adjacent rows of pockets. The elongate space runs from the bottom edge of one row to the top edge of an adjacent row. The elongate spaces control a bending of the poster sized card display apparatus and each of the elongate spaces is of sufficient height such that the rows of pockets of the poster sized card display apparatus may be disposed at angles to each other without folding the cards.

Another feature of the present invention is the provision in such a poster sized card display apparatus, of such elongate spaces having sufficient height such that the poster sized card display apparatus may be folded into a flat form without folding the cards.

Another feature of the present invention is the provision in such a poster sized card display apparatus, of such elongate spaces having sufficient height such that the poster sized card display apparatus may be folded into a triangular tube form without folding the cards.

Another feature of the present invention is the provision in such a poster sized card display apparatus, of such elongate space being formed between the uppermost row of pockets and a header that is at least semi-rigid, and of the header having about the height as a row of pockets such that the header may be folded with the rows of pockets and provide support to the folded form of the poster sized card display apparatus.

Another feature of the present invention is the provision in such a poster sized card display apparatus, of a base of flexible transparent material and sections of flexible transparent material, and of the sections of flexible transparent material forming the rows of pockets, and of the elongate space being between adjacent sections of flexible transparent material such that only the base of flexible transparent material folds instead of both the base and section of flexible transparent material.

Another feature of the present invention is the provision in such a poster sized card display apparatus, of each of the pockets being rectangular in shape and of at least one row of pockets having vertically oriented pockets and at least another row of pockets having horizontally oriented pockets such that both vertically and horizontally oriented cards may be displayed in the poster sized card display apparatus.

Another feature of the present invention is the provision in such a poster sized card display apparatus, of the row of pockets having horizontally oriented pockets being at an end of the poster sized card display apparatus, and of the row of horizontally oriented pockets and an end portion having a combined height of about a row of vertically oriented pockets such that the row of horizontally oriented pockets and end portion fold regularly with the rows of vertically oriented pockets.

Another feature of the present invention is the provision in such a poster sized card display apparatus, of a header where the header is at least semi-rigid and includes a rigidity greater than the base of flexible transparent material.

Another feature of the present invention is the provision in such a poster sized card display apparatus, of the header being sealed between a section of flexible transparent material and the base of flexible transparent material such that the header is viewable from both the front and back sides of the poster sized card display apparatus.

Another feature of the present invention is the provision in such a poster sized card display apparatus, of the header having a height about the height of a row of pockets such that the header folds regularly with the rows of pockets and provides support for the rows of pockets.

Another feature of the present invention is the provision in such a poster sized card display apparatus, of bumpers about the periphery of the apparatus such that the outer edges of the outer cards are isolated from bumps.

Another feature of the present invention is the provision in such a poster sized card display apparatus, of the bumpers comprising double connection portions (i.e., double seals or double welds) between the base of flexible transparent material and a section of flexible transparent material that form the pockets.

Another feature of the present invention is the provision in such a poster sized card display apparatus, of pocket forming connection portions,(i.e., seam or welds) between the base of flexible transparent material and section of flexible transparent material where some of the pocket forming connection portions run at right angles to an elongate fold portion at which the poster sized display card apparatus folds and where the pocket forming connection portions that run at right angles to the elongate fold portion terminate at the elongate fold portion to permit the poster sized card display apparatus to easily fold at the elongate fold portion.

Another feature of the present invention is the provision in such a poster sized card display apparatus, of the pocket forming connection (i.e., seams or welds) lying generally in the same plane as the base of flexible transparent material and where the section of flexible transparent material extends outwardly and in a general U-shape from the base of flexible transparent material to provide easy access to the pocket for easy insertion and removal of the card from the pocket.

An advantage of the invention is that a great many cards may be displayed at one time at one location without handling subsets of cards such as sheets of cards or individual cards. The poster sized display apparatus includes, in its preferred embodiment, 28 pockets. Accordingly, 28 cards may be displayed such that both of the front and back sides of the card may be viewed. Or, if two cards are placed back to back in each of the pockets, 56 cards may be displayed.

Another advantage of the invention is that all of the cards being displayed are protected from bumps and bruises. Even the cards about the periphery of the poster sized card display apparatus are isolated from such periphery by the bumpers (i.e., double seams or welds).

Another advantage of the invention is that the poster sized card display apparatus may be easily converted between a flat display form and a folded flat form for storage or shipping.

Another advantage of the invention is that the poster sized card display apparatus may be easily converted between a flat display form and a folded triangular form for storage or shipping.

Another advantage of the invention is that the poster sized card display apparatus may be easily converted between a flat display form and one of the folded forms with cards in the pockets and without bending or folding of the cards.

Another advantage of the invention is that the poster sized card display apparatus may be easily converted between a flat display form and one of the folded forms without cards in the pockets of the apparatus.

Another advantage of the invention is that the poster sized card display apparatus may be hung on a wall behind a store counter and out of reach of buyers.

Another advantage of the invention is that the poster sized card display apparatus may be hung in a vertical fashion where the card collector has a majority of vertically oriented cards or in a horizontal fashion where the card collector has a majority of horizontally oriented cards.

Another advantage is that the poster sized display apparatus has rigid and flexible sections. A rigid header provides support in the folded form, provides a portion from which to hang the apparatus on a wall, and provides a handle for manipulating the floppy large card display apparatus when it is off the wall. The flexible portion permits the poster sized display apparatus to fold.

Other advantages of the invention include protection for each and every card, visual inspection of each of the cards at the same time without handling the cards and without turning pages or handling individual cards, a large format display of cards while providing for individual pockets for individual cards, the capability to be transformed from a flat display form to a flat stored form, and the capability to be transformed from a flat display form to a triangular tube stored form.

DESCRIPTION

Figure 1:
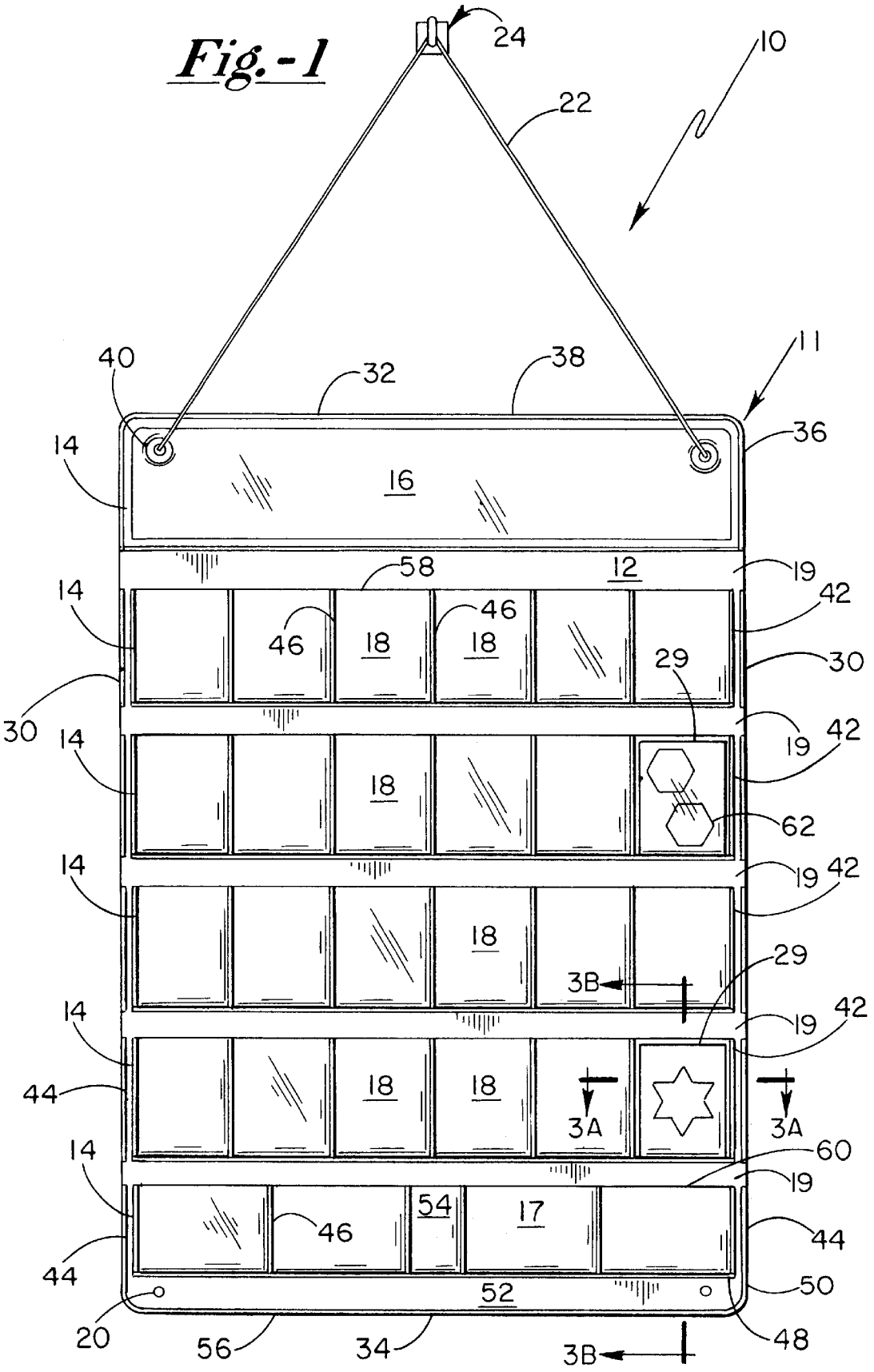
FIG. 1 is a front elevation view of the present poster sized card display apparatus, showing the apparatus in a flat display form hung on the wall.
Figure 5:
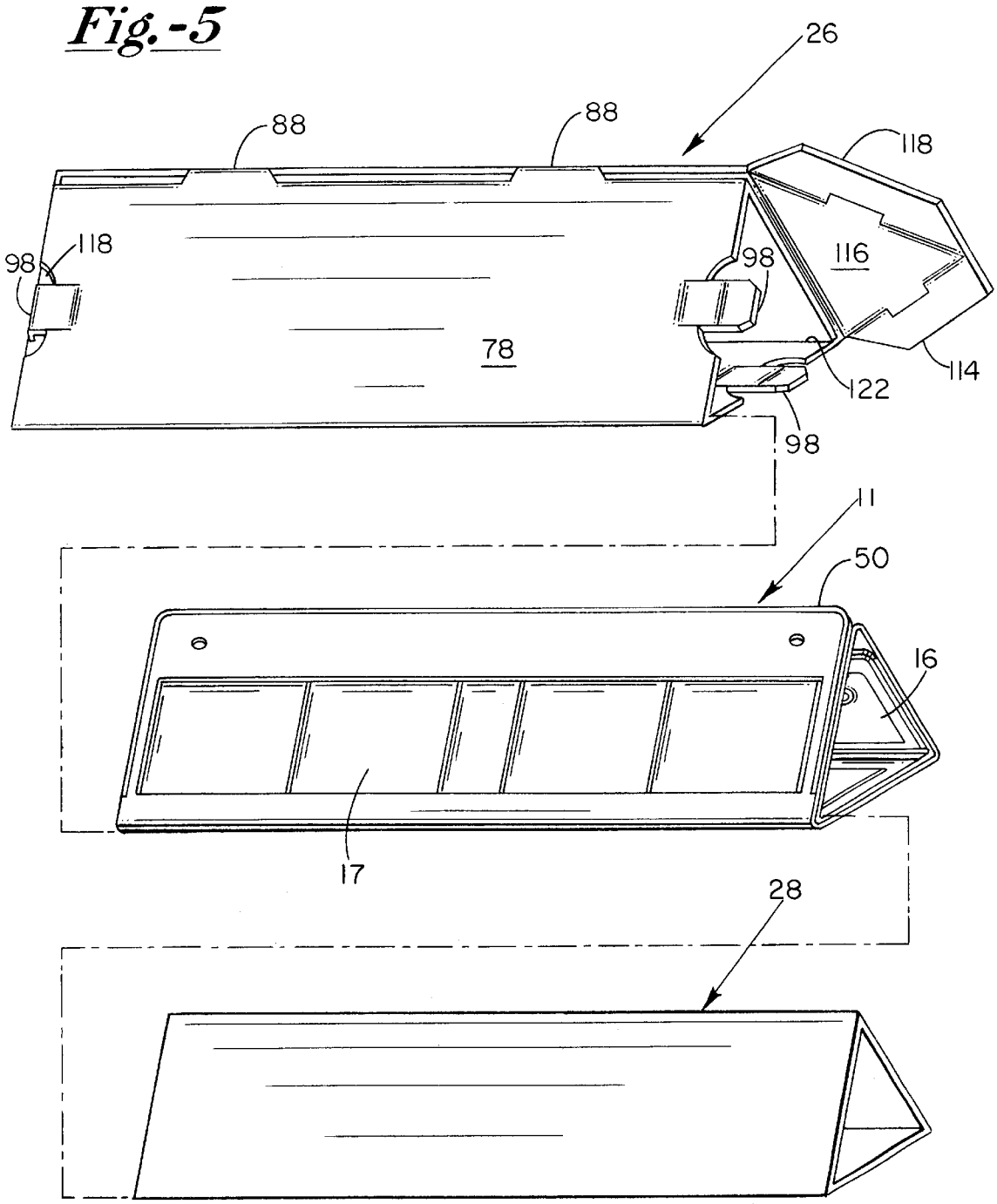
FIG. 5 is an exploded view showing in perspective the poster sized card display apparatus of FIG. 1 folded into a triangular tube form for storage or shipping, further showing in perspective a triangular inner tube support for inserting into the inside of the apparatus when the apparatus is in the triangular tube form, and yet further showing in perspective a shipping triangular tube into which the apparatus is inserted when the apparatus is in the triangular tube form and when the apparatus includes the inner tube support.

As shown in FIG. 1, the present poster sized card display apparatus is generally designated by the reference number 10. The apparatus 10 includes a card holder 11 that generally includes a base 12 of transparent flexible material, a set of sections 14 of transparent flexible material, a header 16 sandwiched between one section 14 and the base 12, a plurality of card pockets 17 and 18 formed between the sections 14 and the base 12, and elongate fold portions 19 of the base 12. The apparatus 10 further generally includes a set of holes 20 in the card holder 11. The apparatus 10 further generally includes a cord 22 that may be engaged with the holes 20, and a swivel hook fixture 24 that may engage the cord 22. As shown in FIG. 5, the apparatus 10 yet further generally includes an outer shipping tube 26 and an inner support tube 28. The pockets 17 and 18 hold conventional cards 29 measuring about 2.5 inches in width and about 3.5 inches in height.

More particularly, the flexible transparent material of the base 12 and sections 14 is plastic that is flexible and transparent. The plastic is preferably a vinyl and more preferably is a polypropylene. The flexible transparent material is a relatively thin plastic sheeting.

The base 12 is preferably rectangular in shape and preferably includes rounded corners. However, if desired, the base 12 may have a square or round shape or some other shape such as an ellipse or such as a football. The base 12 includes side edges 30, an upper or end edge 32 and a lower or end edge 34. The distance between the side edges 30 define a width of the base 12 and the distance between the upper edge 32 and lower edge 34 define a height of the base 12.

The preferred size of the card holder 11 or base 12 may be defined in different ways:

1) The size of the card holder 11 or base 12 is preferably the size of a poster.
2) The width of the card holder 11 or base 12 is preferably between about 14 inches and about 20 inches, more preferably between about 15 and about 19 inches, and most preferably between about 16 and about 18 inches.
3) The height of the card holder 11 or base 12 is preferably between about 18 and about 30 inches, more preferably between about 21 and about 27 inches, and most preferably between about 23 and about 25 inches.
4) The size of the card holder 11 or base 12 is preferably of sufficient size to have between about 22 and about 34 card pockets 17, 18, more preferably of sufficient size to have between about 24 and about 32 card pockets 17, 18, and most preferably of sufficient size to have between about 26 and 30 card pockets 17, 18, where each of the card pockets 17, 18 is only slightly larger than the conventional card that measures about 2.5 inches in width and about 3.5 inches in height. For example, the card pockets 18 may measure about 2.6 inches in width and about 3.6 inches in height and the card pockets 17 may measure about 2.6 inches in height and about 3.6 inches in width.

One of the sections 14 is a header section 36. The width of header section 36 is about the width of the base 12. The header section 36 is engaged to an end (or end portion) of the base 12 via welds 38 (i.e. seals or connection portions). The weld 38 extends about the periphery of the header section 36. The weld 38 is a connection or engagement between the header section 36 and the base 12. The weld 38 (and other welds herein such as welds 44, 46, 48) is waterproof or more particularly, maintains the high water vapor barrier properties of the vinyl or polypropylene of the material of the base 12 and section 36. The header 16 is sandwiched between the header section 36 and base 12 and extends to be closely adjacent to the periphery of the section 36. A pair of grommets 40 pinch the header section 36 and base 12 to the header 16 and provide for holes through which the cord 22 is threaded. The header 16 is preferably of greater rigidity than the flexible material of the base 12 or sections 14, and is more preferably at least semi-rigid. The header 16 is preferably formed of a wood product such as a compressed wood or an engineered wood or a laminated wood. The header 16 may be formed of a chipboard. The header 16 preferably includes graphics. If desired, one side of the header 16 may include graphics indicating a first subject matter such as a first baseball team and the other side of the header may include graphics indicating a second and different subject matter such as a second baseball team. Accordingly, cards from the two different subject matters may be placed back to back in the pockets 17, 18 such that different rosters would appear as one flipped from one side of the card holder 11 to the other side of the card holder 11. It should be noted that header section 36 and the base 12 form a sealed pocket for protecting the graphics of the header 16 from water and dirt. However, if desired, the header 16 may be made be made more narrow (having less height) so as not to engage the grommets 40, and a portion of the welds 36 at one of the side edges 30 may be opened such that the more narrow header 16 may be slid into and out of the sealed pocket such that headers having different graphics may be engaged with the card holder 11. The height of the header section 36 or header 16 is about the height of the other sections 14 and is about the height or slightly greater than the height of a conventional card that measures about 3.5 inches in height. With such a height, the header 16 folds regularly with the other sections 14. With such a height, the header 16 provides support for the other sections 14, their pockets 17, 18, and their cards 29 in the flat form as shown in FIG. 4B or the triangular form shown in FIG. 5. The rigidity of the header 16 controls the "spread" of the card holder 11 when it is hung on a wall such that, for example a middle vertical portion does not droop from the wall. Instead, the rigidity of the header 16 keeps the card holder 11 flat against the wall. The rigidity of the header 16 further permits an easier handling of the card holder 11 when it is in its display form. For example, without the header 16, two hands would be required to spread apart corners of the card holder 11 so as to keep one corner from collapsing under the influence of gravity. The rigidity of the header 16 also permits an easy "rolling up" of the card holder 11 into the triangular tube form shown in FIG. 5.

Figure 3B:
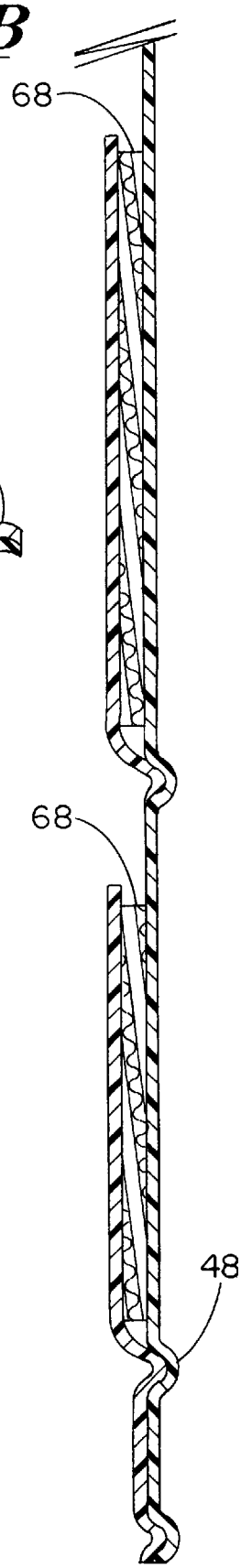
FIG. 3B is a section view at lines 3B—3B of FIG. 1.
Figure 3A:
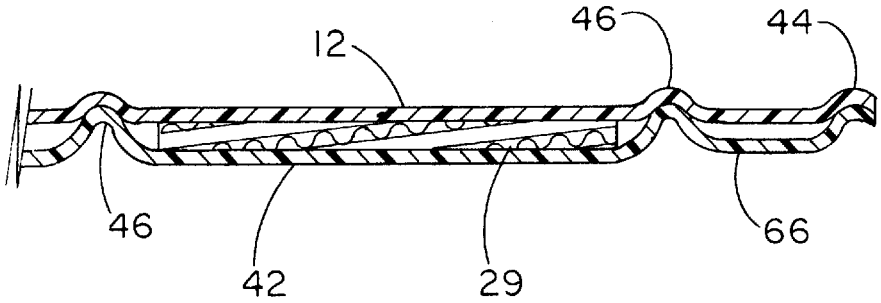
FIG. 3A is a section view at lines 3A—3A of FIG. 1.
Figure 3C:
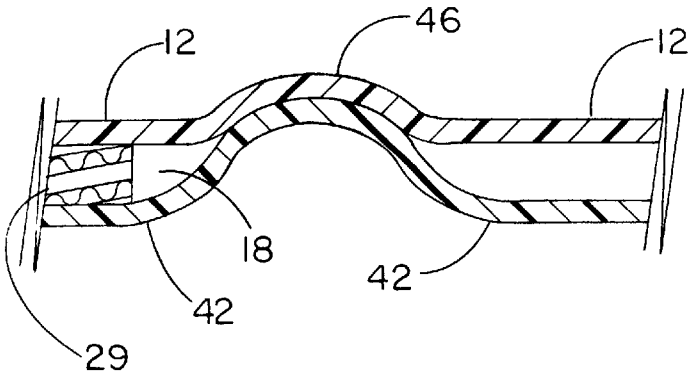
FIG. 3C is a detail view of a portion of FIG. 3A.

Sections 14 include four pocket sections 42 where the pockets 18 are vertically oriented. Pocket sections 42 are welded to the base 12 via three welds. A first weld is an outer vertical weld 44 found at the side edges 30. A second weld is a pocket forming vertical weld 46, two of which form the side edges of a pocket 18. A third weld is a pocket forming horizontal weld 48 that runs just short of one side edge 30 to just short of the other side edge 30 and forms the bottom edge of pockets 18. This third weld 48 terminates at the bottom ends of the outer vertical welds 46 of the outer pockets 48. Each of the vertical welds 46 engage the horizontal weld 48 in a sealing manner. The welds 44, 46, and 48 form portions of the card holder 11 that are more rigid than nonwelded portions and that are more rigid than the double layer of one section 14 over a portion of the base 12 (such as where the pockets 17 and 18 are located, i.e., a double layer of flexible transparent material). A double layer where one section 14 lies over a portion of the base 12 (such as where the pockets 17 and 18 are located, i.e., a double layer of flexible transparent material) is more rigid than the base 12 (i.e., a single layer of flexible transparent material). Accordingly, the outer vertical welds 44 form bumpers relative to the cards placed in the peripheral pockets. Further, one outer vertical weld 44 in combination with the outer vertical weld 46 of such peripheral pocket and further in combination with the double layer between such vertical welds 44 and 46 form an even better bumper to protect the outer edge of the peripheral card 17, 18. Each of the pockets 17, 18 is slightly larger than the conventional card that measures about 2.5 inches in width and about 3.5 inches in height such that the card is fully within the pocket 17, 18. Further, as can be seen in FIGS. 3A, 3B and 3C, welds 46 and 48 lie outside of the plane of the playing card (or outside of the plane defined by the interior of the pockets 17, 18). Such a back location of the welds 46 and 48 thrusts the pocket 17, 18 or the interior of the pocket 17, 18 forwardly. This forward location of the interior of the pocket 17, 18 makes the card more accessible. The card collector need not dig for the card. With such a forward location, the card is inserted into and withdrawn from the pocket 17, 18 more easily.

Sections 14 include one pocket section 50 where the pockets 17 are horizontally oriented. Pocket section 50 includes outer vertical welds 44, pocket forming welds 46 forming the side edges of pockets 17, and a horizontal weld 48 running from just short of one side edge 30 to just short of the other side edge 30. As with sections 42, outer weld 44 is a bumper by itself or in combination with its adjacent vertical weld 46 and the double layer of flexible transparent material between the welds 44 and 46. Section 50 is an end section and includes an end portion 52 that is formed of a double layer of flexible transparent material (provided by section 50 and base 12). This end portion 50 includes holes 20, both of which may be used to hang the card holder "upside down," or one of which may be used (along with one of the holes provided by grommets 40) if the card collector has a great majority of horizontally oriented cards. The end portion 52 is defined by weld 48 of section 50, bottom edge 34, and side edges 30. The height of the end portion 52 plus the height of the row of pockets 17 equals the height of section 50, and this height is about the same as the heights of sections 42 and header section 36 so that the section 50 folds regularly with the other sections 36 and 42. Like pockets 18, the pockets 17 fully encase their respective cards. The height of the pockets 17 is about 2.6 inches. The width of pockets 17 is about 3.6 inches. It should be noted that in the middle of section 50 (between the side edges 30) a smaller pocket 54 is formed. A graphic may be applied to the outside of this pocket 54. Or the pocket 54 may include a card identifying the owner of the card holder 11. End section 50 includes a bottom weld 56 that runs into the outer vertical welds 44 of section 50.

Elongate fold portions 19 are disposed between header section 36 and the uppermost pocket section 42, between each of the adjacent pocket sections 42, and between the lowermost pocket section 42 and the end section 50. In other words, the lower edge or lower weld portion of weld 38 is spaced from an upper edge 58 (disposed at the openings of the pockets 18) of the uppermost section 42, the lower edge of one pocket section 42 is spaced from an upper edge 58 of the pocket section 42 immediately below, and the lower edge of the lowermost pocket section 42 is spaced from an upper edge 60 of the end section 50. The elongate fold portions 19 are the weakest portions of the card holder 11 as these portions 19 include only one layer of flexible transparent material (i.e., include only the base 12). The card holder 11 therefore folds at the elongate fold portions 19. The height of the elongate fold portions 19 is preferably between about 0.25 inches and about 1.0 inches, more preferably between about 0.25 inches and 0.75 inches, and most preferably between about ⅜ inches and about 0.5 inches. The height of the elongate fold portions 19 is preferably sufficiently great such that card holder 11 can be rolled into a flat form where adjacent sections 14 are aligned on top of each other, such that the card holder 11 can be folded into an accordion flat form (as shown in FIG. 4B), and such that the card holder 11 can be rolled into the triangular form shown in FIG. 5. The width of the elongate fold portions 19 is about the width of the base 12. It should also be noted that the rigid vertical welds 44 and 46 terminate at and do not cross or traverse the elongate fold portions 19.

Figure 2:
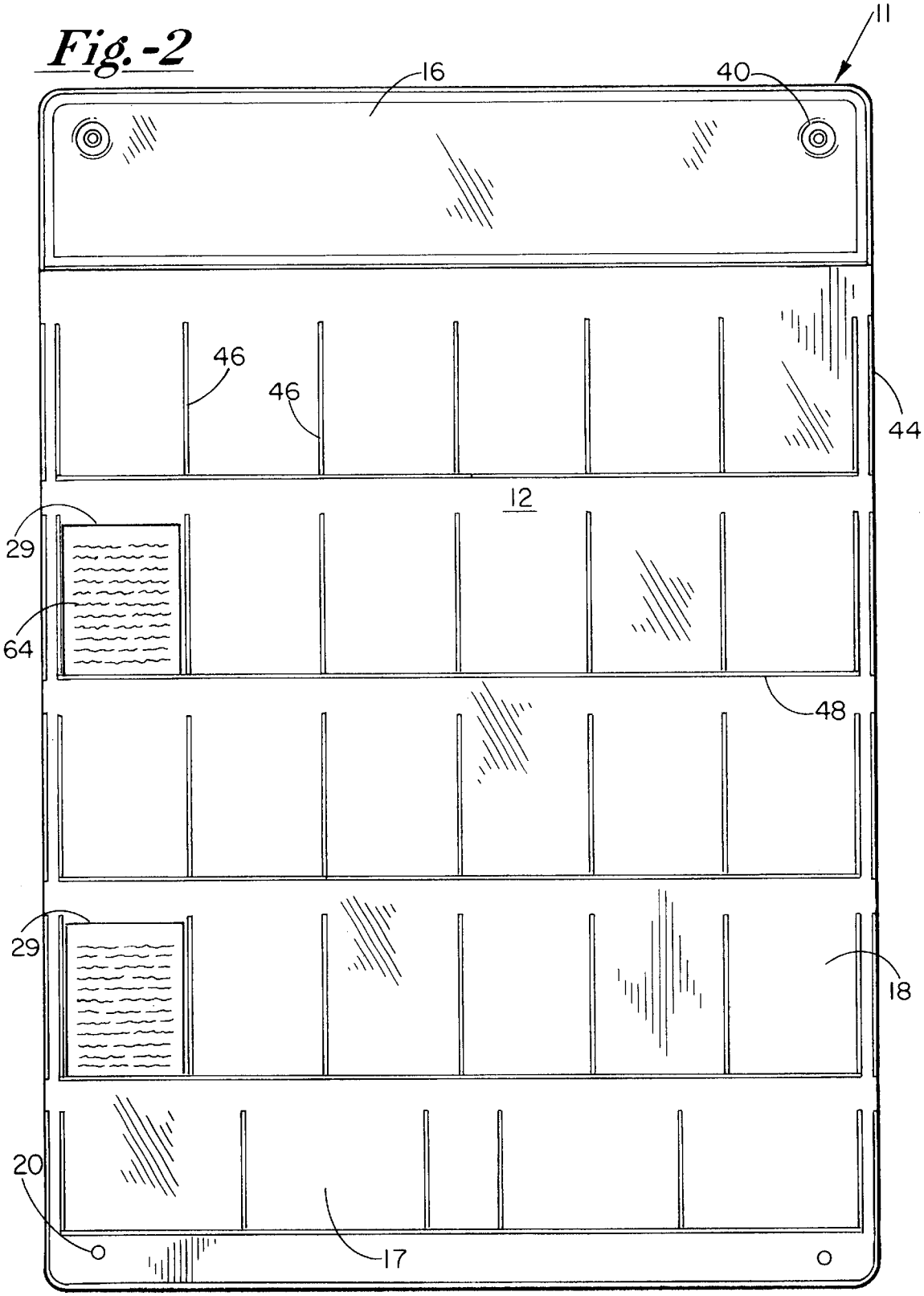
FIG. 2 is a back elevation view of the poster sized card display apparatus of FIG. 1.

From FIGS. 1 and 2, it can be noted that a single card 29 may be visible through the front and back sides of the card holder 11. In other words, the front side of the card 29 (that often contains an image 62 of a character) can be visible through its section 14 and the back side of the card 29 (that often contains information 64 of the character) through the base 12.

In still other words, it should be noted that pockets 17, 18 are preferably only on one side of the two sided apparatus 10

(i.e. of the two sided card holder 11). The base 12 includes a front and rear side. The cards 29 include front and rear sides. The sections 14 are engaged to the front side of the base 12. Accordingly, when in the pockets 17, 18, the front sides of the cards 29 are visible through the sections 14 and the rear sides of the cards 29 are visible through the rear side of the base 12.

FIGS. 3A, 3B and 3C show that the welds 44, 46, and 48 are formed in a plane outside of the plane of the interior of the pocket 18 (or 17) to thereby make the interior of the pocket 18 (or 17) and the card in the pocket more accessible to the fingers. In other words, the base 12 lies in a first plane and the welds 44, 46 and 48 are formed partially in this first plane and extend partially out beyond the first plane and away from the side of the holder 11 having the pockets 17, 18. This rear or back face of the card holder 11 has ridges formed by these welds 44, 46, 48. The plane in which the interiors of the pockets 17, 18 lies is a second plane offset from the welds 44, 46, 48 and offset from the first plane. FIG. 3A shows that the double layer of flexible material between vertical weld 44 and its adjacent vertical weld 46 is a bottomless pocket 66 since the horizontal weld 48 terminates short of edges 30 and welds 44. FIG. 3B shows that each of the pockets 17 or 18 includes an opening 68 through which the cards are inserted and withdrawn.

Figure 4A:
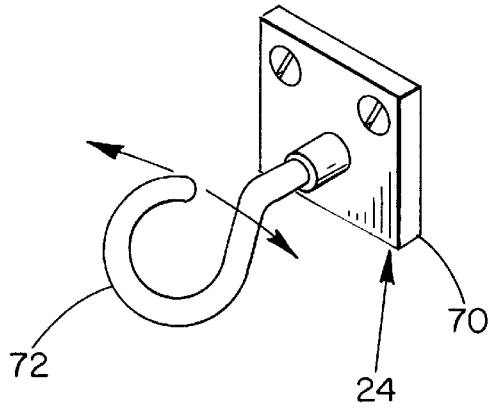
FIG. 4A is a perspective view of a swivel hook fixture for the poster sized card display apparatus of FIG. 1.
Figure 4B:
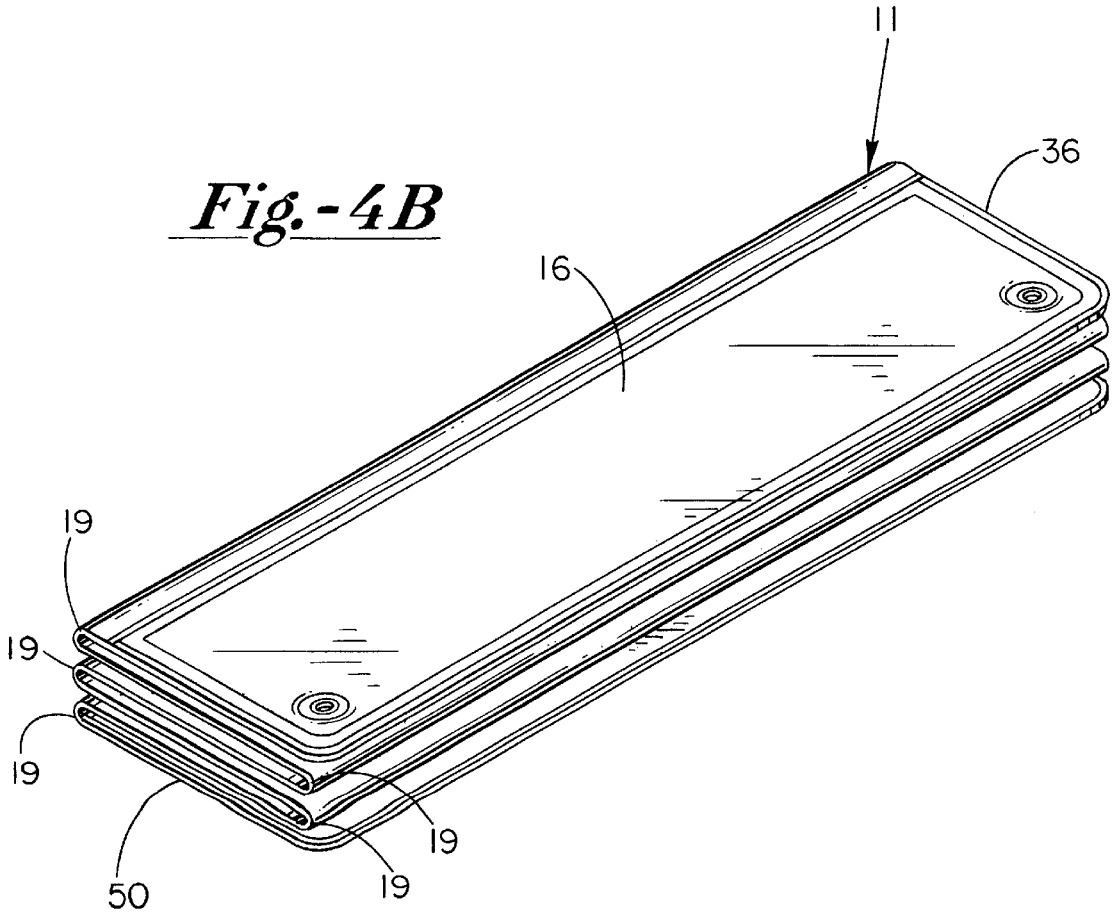
FIG. 4B is perspective view of a flat compact form of the poster sized card display apparatus of FIG. 1, showing the apparatus folded accordion style into a flat form for storage or shipping.

FIG. 4A shows the swivel hook fixture 24. The swivel hook fixture 24 includes a base 70 that may be screwed, nailed, taped, or glued to a wall or other surface. Extending from and rotatably journaled to the base 70 is a swivel hook 72. The hook 72 may rotate fully 360 degrees or more in either direction of rotation. Accordingly, when the cord 22 is hung on the hook 72 and the card holder 11 is swung from its front side to its back side and when the hook 72 is rotated 360 degrees or more in the complementary direction of rotation, the cord 22 does not twist about itself.

FIG. 4B shows that the sections 14 are aligned with each other when the card holder 11 is folded accordion style. FIG. 4B further shows that the heights of the sections 14 are about equal with each other. FIG. 4B still further shows that the card holder 11 in the accordion style is a flat form. It is noted that the card holder 11 when in the display form is also flat.

FIG. 5 is an exploded view showing how the card holder 11 may be packaged. First, the card holder 11 is folded, beginning with the header section 36. The fold is a roll type fold, not an accordion type fold. Upper edge 32 is placed along the elongate fold portion 19 that is the third elongate fold portion 19 from the top edge 32, and then the card holder 11 is rolled such that elongate fold portions 19 become aligned with each other. The header section 36, with the semi-rigid header 16 therein, provides an inner support for the tube form of the card holder 11. Then the inner triangular tube support 28 is placed in the triangular card holder 11. Then the triangular card holder 11 having the inner triangular tube support 28 is slid into the triangular shipping tube 26.

Figure 6:
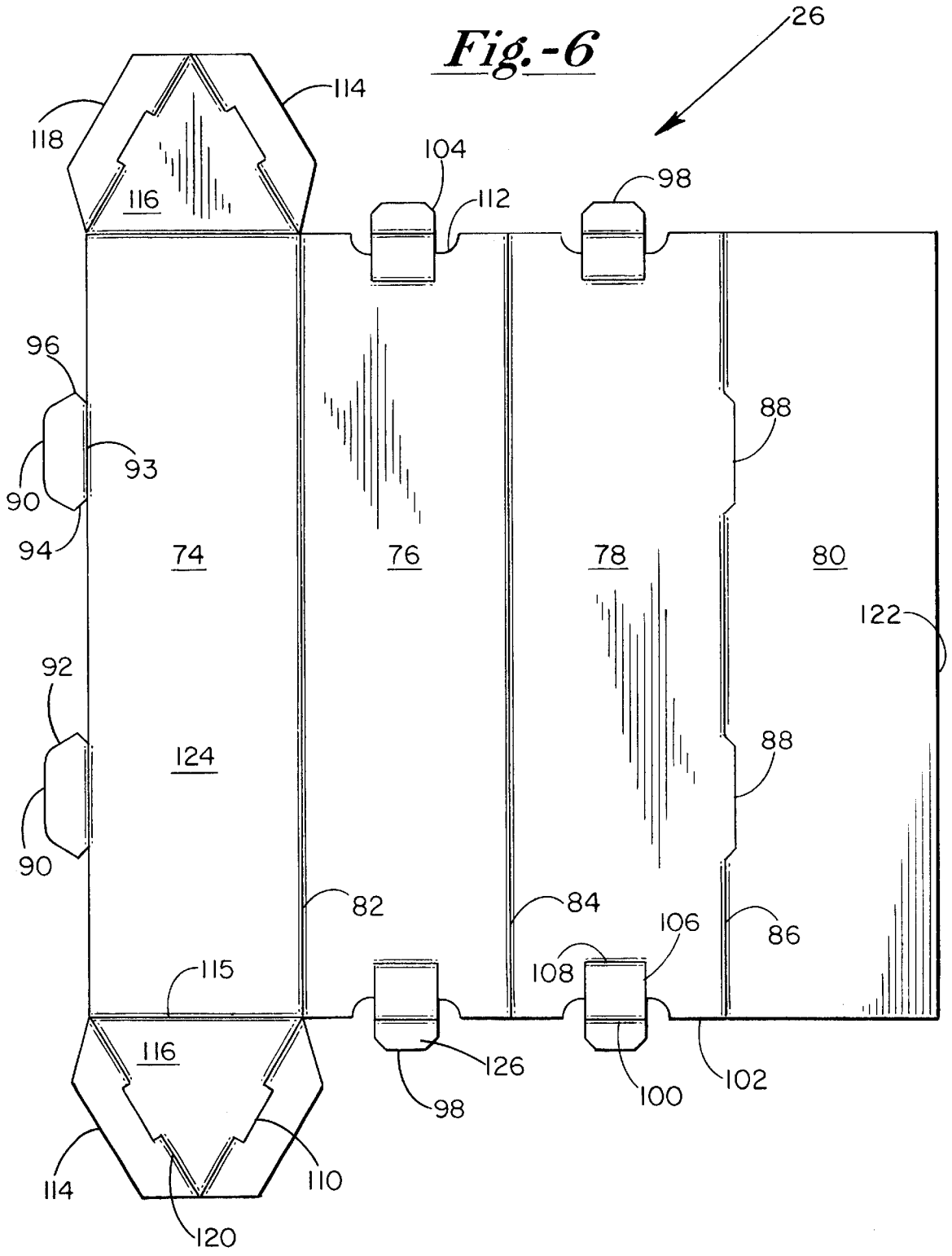
FIG. 6 is a top view of a cardboard layout or pattern for the shipping triangular tube of FIG. 5, prior to the cardboard layout being folded into the shipping triangular tube.

FIG. 6 shows a layout or pattern for the triangular shipping tube 26. The tube 26 includes four integral cardboard sides 74, 76, 78, 80 which are about equal width and about equal height. A first fold line 82 is disposed between sides 74 and 76, a second fold line 84 is disposed between sides 76 and 78, and a third fold line 86 is disposed between sides 78 and 80. Fold lines 82 and 84 are continuous. Fold line 86 is discontinuous. Generally in line with fold line 86 is a pair of U-shaped cutouts or tab slots 88. The sides of each of the U cuts are flared. Tab slots 88 cooperate with tabs 90 that are integral with and extend from side 74. Each of the tabs 90 includes a pair of guide edges 92, a fold line 93, and a pair of locking edges 94. An apex 96 is disposed between the two edges 92 and 94. The distance between the two apices 96 of one tab 90 is greater than the length of the tab slot 88 such that tab 90 is partially compressed as it enters tab slot 88 and such that tab 90 then expands after it has passed through said tab slot 88 so as to lock the edges 94 in place. Each of the sides 76 and 78 includes opposing tabs 98. Each of the opposing tabs 98 includes a fold line 100 that is aligned with an end edge 102 of sections 76, 78. Each of the tabs 98 includes guide edges 104. Each of the tabs 98 is somewhat elongate. Each of the tabs 98 is further formed by a pair of cuts 106 and a fold line 108. Each of the tabs 98 cooperates with a respective tab slot 110. About each of the tabs 98 is a rounded cutout 112 to provide space for fingers to reach in and grab tab 98 and pull it out of its respective tab slot 110. The tube 26 further includes caps 114 integral with side 74 and sharing a fold line 115 with side 74. Each of the caps 114 includes a triangular main body 116, and a pair of inner support flaps 118. Each of the flaps 118 shares a fold line 120 with the main body 116. Each of the fold lines 120 is discontinuous as the tab slot 110 for tab 98 is aligned with the fold line 120. The width of the distance between cuts 106 of tab 98 is equal to or slightly greater than the width of U-shaped slot 110 to provide slight resistance to insertion and withdrawal of tab 98 relative to slot 110. In operation, to fold the tube 26 from its pattern form to the operating tube form, an outer edge 122 of side 80 is placed on fold line 82. Then an outer face of side 80 is laid flat against inner face 124 of side 74 and the tabs 90 are locked into slots 88. Flaps 118 of one cap 114 are then bent a right angles relative to main body 116 and in this orientation the cap 114 is inserted into an open end of the tube 26. FIG. 5 shows that the flaps 118 are of sufficient size to cover the cutout portions 112. Tabs 98 are then bent at fold lines 100 and outer portions 126 of tabs 98 are then inserted into their respective slots 110. Then the card holder 11 (that has been folded into a triangular shape and that includes the inner support tube 28) is inserted into the tube 26 and then the flaps 118 of the other cap 114 are bent and tucked in the other open end of the tube 26 such that the tube 26 is now closed at both ends. For shipping, tape may be engaged over the cooperating tabs 90, 98 and their respective slots 88, 110.

As to other embodiments of the invention, it should be noted that individual cards may be sealed in individual pockets. That is, opening 68 of pocket 17 or 18 may be permanently or releasably sealed by permanently or releasably connecting an upper portion of section 14 to the base 12 after the card 29 has been inserted therein. A permanent seal may be a weld (like weld 46) where such permanent seal runs across opening 68 to welds 46 that form the sides of the pockets 17 and 18. A releasable seal may be a seal as found in plastic sandwich bags. A releasable seal too may run across opening 68 to welds 46 that form the sides of the pockets 17 and 18. A card holder 11 having one or more permanently sealed or releasable sealed pockets may be used for, by way of example, classic collections or collections intended to be stored in mint condition.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A poster sized card display apparatus for displaying a plurality of cards, with the poster sized card display apparatus having a first side and a second side, with each of the cards having a first side and a second side, with the first and second sides of the cards being visible through respective first and second sides of the poster sized card display apparatus, with the poster sized card display apparatus comprising:

a) a base of flexible transparent material such that the cards are visible through said base of flexible transparent material, with the base of flexible transparent material being generally the size of a poster, with the base of flexible transparent material having a first side and a second side, with the base of flexible transparent material having a width and a height;

b) at least one section of flexible transparent material engaged to the first side of the base of flexible transparent material such that cards are visible through said section of flexible transparent material, with said at least one section of flexible transparent material in combination with said base of flexible transparent material forming a plurality of pockets therebetween, with the plurality of pockets comprising rows of pockets, with each of the pockets sized to accept one of said cards, with each of the pockets having an opening for insertion and withdrawal of one of said cards, with the first sides of the cards being visible through said at least one section of flexible transparent material and with the second sides of the cards being visible through the base of flexible transparent material;

c) wherein each of the rows of pockets has an upper edge and a lower edge, and with each of the rows of pockets having a height and width; and d) an elongate space running between adjacent rows of pockets, wherein said elongate space is formed by said upper edge of one row of pockets being spaced from said lower edge of an adjacent row of pockets, with said elongate space permitting the base of flexible transparent material to fold along said elongate space such that one row of pockets is disposed at an angle relative to an adjacent row of pockets whereby when cards are in the pockets the poster sized card display apparatus is foldable without folding the cards.

2. A poster sized card display apparatus for displaying a plurality of cards according to claim 1, wherein the poster sized card display apparatus includes a flat form, wherein the elongate space includes a width and a height, with the height of the elongate space being sufficient such that one row of pockets is foldable to lie flat on an adjacent row of pockets such that the poster sized card display apparatus is shippable in the flat form.

3. A poster sized card display apparatus for displaying a plurality of cards according to claim 1, wherein the poster sized card display apparatus includes a triangular tube form, wherein the elongate space includes a width and a height, with the height of the elongate space being sufficient such that one row of pockets is foldable to lie at about a 60 degree angle relative to an adjacent row of pockets such that the poster sized card display apparatus is shippable in triangular tube form.

4. A poster sized card display apparatus for displaying a plurality of cards according to claim 1, and further comprising a header, with the header being at least semi-rigid, with a width of the header being about the width of the rows of pockets, with a height of the header being about the height of said row of pockets, with the header having a lower edge, with the lower edge being spaced from said upper edge of the row of pockets that is adjacent to the header such that another elongate space is formed between said header and said row of pockets that is adjacent to the header, such that the base of transparent material is foldable along said another elongate space, such that the header may be disposed at an angle relative to said adjacent row of pockets, and such that the header provides support for the rows of pockets when the poster sized card display apparatus is folded and shipped.

5. A poster sized card display apparatus for displaying a plurality of cards according to claim 1, and further comprising additional sections of flexible transparent material, with each of the sections of flexible transparent material comprising one of said rows of pockets.

6. A poster sized card display apparatus for displaying a plurality of cards according to claim 1, and further comprising additional sections of flexible transparent material, with each of the sections of flexible transparent material comprising one of said rows of pockets, with each of the sections having an upper edge and a lower edge, and with said elongate space being between and terminating at an upper edge of one section of flexible transparent material and a lower edge of another section of flexible transparent material such that only the base of flexible transparent material folds along said elongate space instead of both said base and said section of flexible transparent material.

7. A poster sized card display apparatus for displaying a plurality of cards according to claim 1, wherein the poster sized card display apparatus comprises five rows of pockets.

8. A poster sized card display apparatus for displaying a plurality of cards, with the poster sized card display apparatus having a first side and a second side, with each of the cards having a first side and a second side, with the first and second sides of the cards being visible through respective first and second sides of the poster sized card display apparatus, with the poster sized card display apparatus comprising:

a) a base of flexible transparent material such that the cards are visible through said base of flexible transparent material, with the base of flexible transparent material being generally the size of a poster, with the base of flexible transparent material having a first side and a second side, with the base of flexible transparent material having a width and a height;

b) at least one section of flexible transparent material engaged to the first side of the base of flexible transparent material such that cards are visible through said section of flexible transparent material, with said at least one section of flexible transparent material in combination with said base of flexible transparent material forming a plurality of pockets therebetween, with the plurality of pockets comprising rows of pockets, with each of the pockets sized to accept one of said cards, with each of the pockets having an opening for insertion and withdrawal of one of said cards, with the first sides of the cards being visible through said at least one section of flexible transparent material and with the second sides of the cards being visible through the base of flexible transparent material;

c) wherein each of the pockets is rectangular in shape, with each of the pockets having a width and a height;

d) wherein one row of pockets has first direction oriented pockets such that each of the pockets of said row has a height greater than a width; and e) wherein another row of pockets has second direction oriented pockets such that most of the pockets of said row has a width greater than a height, with the first and second directions being at right angles relative to each other whereby both vertically and horizontally oriented cards may be displayed in the poster sized card display apparatus.

9. A poster sized card display apparatus for displaying a plurality of cards according to claim 8, wherein the base of transparent material includes an end, with the end having a width and a height, with the end being adjacent to the row of pockets having the second direction oriented pockets, with the width of the end being about the width of the row having the second direction oriented pockets, with the height of the end plus the height of the row of second direction oriented pockets being about equal to the height of the row having the first direction oriented pockets such that the end and row of second direction oriented pockets fold regularly with the other rows of pockets.

10. A poster sized card display apparatus for displaying a plurality of cards according to claim 9, wherein said end comprises a hole for permitting the poster sized card display apparatus to be hung on a wall.

11. A poster sized card display apparatus for displaying a plurality of cards according to claim 8, and further comprising four corner portions, with at least three of the corner portions comprising a hole for hanging the poster sized card display apparatus on a wall, wherein two of the holes may be utilized for hanging the poster sized card display apparatus such that the pockets that are first direction oriented are vertically oriented and such that the pockets that are second direction oriented are horizontally oriented, and wherein two of the holes may be utilized for hanging the poster sized card display apparatus such that the pockets that are first direction oriented are horizontally oriented and that pockets that are second direction oriented are vertically oriented.

12. A poster sized card display apparatus for displaying a plurality of cards according to claim 8, wherein the poster sized card display includes at least four rows of pockets having first direction oriented pockets.

13. A poster sized card display apparatus for displaying a plurality of cards, with the poster sized card display apparatus having a first side and a second side, with each of the cards having a first side and a second side, with the first and second sides of the cards being visible through respective first and second sides of the poster sized card display apparatus, with the poster sized card display apparatus comprising:

a) a base of flexible transparent material such that the cards are visible through said base of flexible transparent material, with the base of flexible transparent material being generally the size of a poster, with the base of flexible transparent material having a first side and a second side, with the base of flexible transparent material having a width and a height;

b) at least one section of flexible transparent material engaged to the first side of the base of flexible transparent material such that cards are visible through said section of flexible transparent material, with said at least one section of flexible transparent material in combination with said base of flexible transparent material forming a plurality of pockets therebetween, with the plurality of pockets comprising rows of pockets, with each of the pockets sized to accept one of said cards, with each of the pockets having an opening for insertion and withdrawal of one of said cards, with the first sides of the cards being visible through said at least one section of flexible transparent material and with the second sides of the cards being visible through the base of flexible transparent material;

c) wherein the base of flexible transparent material comprises an end, with the end having a width about the width of one of said rows of pockets, with the end having a height about the height of one of said rows of pockets; and d) a header, with the header being at least semi-rigid, with the header having a greater degree of rigidity than the base of flexible transparent material, with the header being engaged with the end, with the header having a width about the width of the end, with the header having a height about the height of the end;

e) such that when the poster sized card display apparatus is in a folded form the header provides support for said rows of pockets and folds regularly with said rows of pockets; and f) such that when the poster sized card display apparatus is in a display form the header provides a degree of rigidity to the base of flexible transparent material and to said at least one section of flexible transparent material.

14. A poster sized card display apparatus for displaying a plurality of cards according to claim 13, further comprising a section of flexible transparent material over the header such that the header is visible through the flexible transparent material, with the section of flexible transparent material having a width about the width of the end and a height about the height of the end, with the header being between said section of flexible transparent material and the end whereby the header is visible from the front side and the back side of the poster sized card display apparatus, and with the section of flexible transparent material having a periphery that is sealed to the base of flexible transparent material.

15. A poster sized card display apparatus for displaying a plurality of cards, with the poster sized card display apparatus having a first side and a second side, with each of the cards having a first side and a second side, with the first and second sides of the cards being visible through respective first and second sides of the poster sized card display apparatus, with the poster sized card display apparatus comprising:

a) a base of flexible transparent material such that the cards are visible through said base of flexible transparent material, with the base of flexible transparent material being generally the size of a poster, with the base of flexible transparent material having a first side and a second side, with the base of flexible transparent material having a width and a height;

b) at least one section of flexible transparent material engaged to the first side of the base of flexible transparent material such that cards are visible through said section of flexible transparent material, with said at least one section of flexible transparent material in combination with said base of flexible transparent material forming a plurality of pockets therebetween, with the plurality of pockets comprising rows of pockets, with each of the pockets sized to accept one of said cards, with each of the pockets having an opening for insertion and withdrawal of one of said cards, with the first sides of the cards being visible through said at least one section of flexible transparent material and with the second sides of the cards being visible through the base of flexible transparent material;

c) wherein the base of transparent material has a periphery;

d) wherein the pockets are formed by forming first connection portions between the base of flexible transparent material and said at least one section of flexible transparent material, with said first connection portions connecting the base of flexible transparent material with said at least one section of flexible transparent material; and e) second connection portions about the periphery, with said second connection portions connecting the base of flexible transparent material with said at least one section of flexible transparent material, with said second connection portion being disposed adjacent to and spaced from outermost pockets of each of the rows, with said second connection portion being disposed adjacent to and spaced from said first connection portion forming an outermost portion of an outermost pocket such that a second connection portion and a first connection portion form a double connection portion between the periphery and the outer edges of cards located in said outermost pockets to isolate said outer edges of said cards from bumps applied to said periphery of the base of transparent material.

16. A poster sized card display apparatus for displaying a plurality of cards, with the poster sized card display apparatus having a first side and a second side, with each of the cards having a first side and a second side, with the first and second sides of the cards being visible through respective first and second sides of the poster sized card display apparatus, with the poster sized card display apparatus comprising:

a) a base of flexible transparent material such that the cards are visible through said base of flexible transparent material, with the base of flexible transparent material being generally the size of a poster, with the base of flexible transparent material having a first side and a second side, with the base of flexible transparent material having a width and a height;

b) at least one section of flexible transparent material engaged to the first side of the base of flexible transparent material such that cards are visible through said section of flexible transparent material, with said at least one section of flexible transparent material in combination with said base of flexible transparent material forming a plurality of pockets therebetween, with the plurality of pockets comprising rows of pockets, with each of the pockets sized to accept one of said cards, with each of the pockets having an opening for insertion and withdrawal of one of said cards, with the first sides of the cards being visible through said at least one section of flexible transparent material and with the second sides of the cards being visible through the base of flexible transparent material;

c) wherein the base of transparent material has a periphery;

d) wherein the pockets are formed by forming first connection portions between the base of flexible transparent material and said at least one section of flexible transparent material, with said first connection portions connecting said base of flexible transparent material and said at least one section of flexible transparent material;

e) wherein the base of flexible transparent material includes elongate fold portions along which said base of flexible transparent material folds; and f) wherein some of the first connection portions run at right angles relative to said elongate fold portions, and with the first connection portions that run at right angles relative to said elongate fold sections terminating at said elongate fold portions, with some of the first connection portions that run at right angles relative to said elongate fold sections being disposed in line with each other and having adjacent ends spaced from each other across said elongate fold section whereby folding action of said elongate fold sections is maximized.

17. A poster sized card display apparatus for displaying a plurality of cards, with the poster sized card display apparatus having a first side and a second side, with each of the cards having a first side and a second side, with the first and second sides of the cards being visible through respective first and second sides of the poster sized card display apparatus, with the poster sized card display apparatus comprising:

a) a base of flexible transparent material such that the cards are visible through said base of flexible transparent material, with the base of flexible transparent material being generally the size of a poster, with the base of flexible transparent material having a first side and a second side, with the base of flexible transparent material having a width and a height;

b) at least one section of flexible transparent material engaged to the first side of the base of flexible transparent material such that cards are visible through said section of flexible transparent material, with said at least one section of flexible transparent material in combination with said base of flexible transparent material forming a plurality of pockets therebetween, with the plurality of pockets comprising rows of pockets, with each of the pockets sized to accept one of said cards, with each of the pockets having an opening for insertion and withdrawal of one of said cards, with the first sides of the cards being visible through said at least one section of flexible transparent material and with the second sides of the cards being visible through the base of flexible transparent material;

c) wherein each of the rows of pockets has an upper edge and a lower edge, and with each of the rows of pockets having a height and width;

d) an elongate space running between adjacent rows of pockets, wherein said elongate space is formed by said upper edge of one row of pockets being spaced from said lower edge of an adjacent row of pockets, with said elongate space permitting the base of flexible transparent material to fold along said elongate space such that one row of pockets is disposed at an angle relative to an adjacent row of pockets whereby when cards are in the pockets the poster sized card display apparatus is foldable without folding the cards;

e) wherein each of the pockets is rectangular in shape, with each of the pockets having a width and a height;

f) wherein one row of pockets has first direction oriented pockets such that each of the pockets of said row has a height greater than a width;

g) wherein another row of pockets has second direction oriented pockets such that most of the pockets of said row has a width greater than a height, with the first and second directions being at right angles relative to each other whereby both vertically and horizontally oriented cards may be displayed in the poster sized card display apparatus;

h) wherein the base of flexible transparent material comprises an end, with the end having a width about the width of one of said rows of pockets, with the end having a height about the height of one of said rows of pockets;

i) a header, with the header being at least semi-rigid, with the header having a greater degree of rigidity than the base of flexible transparent material, with the header being engaged with the end, with the header having a width about the width of the end, with the header having a height about the height of the end;

j) such that when the poster sized card display apparatus is in a folded form the header provides support for said rows of pockets and folds regularly with said rows of pockets; and k) such that when the poster sized card display apparatus is in a display form the header provides a degree of rigidity to the base of flexible transparent material.

18. A poster sized card display apparatus for displaying a plurality of cards, with the poster sized card display apparatus having a first side and a second side, with each of the cards having a first side and a second side, with the first and second sides of the cards being visible through respective first and second sides of the poster sized card display apparatus, with the poster sized card display apparatus comprising:

a) a base of flexible transparent material such that the cards are visible through said base of flexible transparent material, with the base of flexible transparent material being generally the size of a poster, with the base of flexible transparent material having a first side and a second side, with the base of flexible transparent material having a width and a height;

b) at least one section of flexible transparent material engaged to the first side of the base of flexible transparent material such that cards are visible through said section of flexible transparent material, with said at least one section of flexible transparent material in combination with said base of flexible transparent material forming a plurality of pockets therebetween, with the plurality of pockets comprising rows of pockets, with each of the pockets sized to accept one of said cards, with each of the pockets having an opening for insertion and withdrawal of one of said cards, with the first sides of the cards being visible through said at least one section of flexible transparent material and with the second sides of the cards being visible through the base of flexible transparent material;

c) wherein each of the pockets is formed by a connection portion between said at least one section of flexible transparent material and said base of flexible transparent material, with said base of flexible transparent material lying in a first plane;

d) wherein each of said pockets includes an interior lying generally in a second plane; and e) wherein said connection portion is offset from said second plane and extends from said first plane.

* * * * *